US009999330B2

(12) United States Patent
Fang

(10) Patent No.: US 9,999,330 B2
(45) Date of Patent: Jun. 19, 2018

(54) ROLLER BRUSH ASSEMBLY

(71) Applicant: NINGBO FUJIA INDUSTRIAL CO., LTD., Yuyao (CN)

(72) Inventor: Jianqiang Fang, Yuyao (CN)

(73) Assignee: NINGBO FUJIA INDUSTRIAL CO., LTD., Yuyao (CN)

( * ) Notice: Subject to any disclaimer, the term of this patent is extended or adjusted under 35 U.S.C. 154(b) by 0 days. days.

(21) Appl. No.: 15/376,670

(22) Filed: Dec. 13, 2016

(65) Prior Publication Data

US 2017/0311767 A1 Nov. 2, 2017

(30) Foreign Application Priority Data

Apr. 29, 2016 (CN) ..... 2016 1 0279651

(51) Int. Cl.
*A47L 9/04* (2006.01)
*A47L 11/19* (2006.01)

(52) U.S. Cl.
CPC ..... *A47L 9/0477* (2013.01); *A47L 9/0411* (2013.01); *A47L 11/19* (2013.01)

(58) Field of Classification Search
CPC ..... A47L 9/0477; A47L 9/0411; A47L 11/19
See application file for complete search history.

(56) References Cited

U.S. PATENT DOCUMENTS 6,539,575 B1 * 4/2003 Cohen ..... A46B 13/001 15/179
2014/0053362 A1 * 2/2014 Hosterman ..... A47L 9/00 15/256.52

FOREIGN PATENT DOCUMENTS

| | | | |
|---|---|---|---|
| CN | 202096154 | U | 1/2012 |
| CN | 203138354 | U | 8/2013 |
| CN | 203619474 | U | 6/2014 |
| CN | 104248397 | A | 12/2014 |
| CN | 204797748 | U | 11/2015 |
| CN | 205072787 | U | 3/2016 |

* cited by examiner

*Primary Examiner* — Randall Chin
(74) *Attorney, Agent, or Firm* — Gokalp Bayramoglu

(57) ABSTRACT

A roller brush assembly comprises a roller and a brush set on the roller. The roller contains an interior cavity constituted by at least two barrel bodies. Each portion of the barrel body edge is serrated shaped, and the adjacent serrated-shaped portions of the barrel both form a blade slot for positioning the serrated-shaped blade, and the blade edge corresponds to the teeth on the serrated shaped edge. A driver unit is installed in the interior cavity to make the blade move along the roller axially to cut the wrapped in the tooth groove automatically when the roller brush is turned on and off.

18 Claims, 5 Drawing Sheets

ROLLER BRUSH ASSEMBLY

TECHNICAL FIELD

The present disclosure relates to the field of cleaning tools, and particularly relates to a roller brush assembly used with vacuum cleaner.

BACKGROUND

The vacuum cleaner is a common cleaning device, generally including a dust collector, a filter assembly and a vacuum source. Through the suction of the vacuum source and the filtration of the filler assembly, dust or debris are collected in the dust collector. In order to improve the cleaning efficiency, a brush is usually provided in the dust suction port in the bottom of the vacuum cleaner. However, during operation, the brush, particularly electrical roller brush, is easily entangled by filaments on the floor such as hair etc. Due to the rotating movement, a roller brush is more easily wrapped by hair or similar filaments, which not only affects the dust collecting effect, but also stalls the motor and damages the transmission mechanism. Thus, the user has to open the cover of the brush or even turn over the entire floor brush to clean these filaments after shutting down the machine, finding it a cumbersome process to remove. It has become a difficult problem to solve for users and manufacturers.

To seek solutions to the above mentioned wrapping problem, many attempts have been made by manufacturers, mainly including the following:

1. A cutting knife is arranged on the outer housing of the brush, and users can move the cutting knife manually to cut the wrapped on the brush.

As patent CN202096154U discloses a roller brush for a vacuum cleaner, a groove is spirally set on the outer surface of the roller brush core for the insertion of the cutting knife. The cutting edge of the cutting knife is inserted in the groove and can be moved along the groove to cut the winding hair on the outer surface of the roller brush core.

As patent CN203619474U discloses a floor brush which applied on cleaning apparatus. A cutting knife is installed on the main shaft or the outer housing of the roller brush, and an axially extending slide groove on the outer wall of the main shaft of the roller brush. The cutting knife can be moved along the sliding groove by external force to cut off the winding debris on, the main shaft of the roller brush.

As patent CN204797748U discloses a floor brush assembly, the shell is provided with a cleaning device including a knife and a knife handle, when the cleaning device is moved, the knife can cut off the winding hair on the brush.

2. The shell is provided with a cutter, and with downward pressure the cutter is in contact with the roller brush to cut off the wrapped.

As patent CN203138354U discloses a floor brush with fixed blade structure, the base is provided with a tool rest and a blade, when the user presses downward, the base of the blades is in contact with the brush and the cutting part of the blade can cut off the wound hair and the like.

As patent CN205072787U discloses a floor brush assembly, a tool holder is mounted on the housing, and a blade is fixedly mounted on the tool rest. When the pedal is stepped by a user, an external force is applied on the tool rest. The rotation of the tool rest drives the blade to be in contact with the roller brush to cut the wrapped with the serrated edge.

3. A separate cutting member is set inside, and be in contact with the roller brush during the rotation of the roller brush to remove the wrapped.

As patent CN104248397A discloses a cleaning device including a cleaning comb, with the rotation of the roller brush, the front section of the cleaning comb teeth inserts into the brush, and a blade is close to the outer edge of the roller brush to cut off the wrapped while avoiding cutting the brush.

There are still a number of problems in the solutions described above. In the first solution, the cutting knife is independently arranged on the housing; the user must bend down, squat or turn over the entire cleaning implement to move the cutting knife manually to cut the wrap. Since the cutter is an added part, comparatively easy to be damaged and dangerous to operate. In the second solution, the user must press downwards to clean, and the brush may be cut as well during the contact with the blade. In the third solution, although the brush may not be cut, a low cleaning efficiency is anticipated, and a complicated structure results in an easy damage and difficulty to maintain.

SUMMARY OF THE INVENTION

The present disclosure relates to a roller brush assembly, which can cut off the wrapped on the roller brush automatically.

The technical scheme is as follows:

A roller brush assembly comprising a roller and a brush set on the roller; it is characterized in that the roller contains an interior cavity constituted by at least two barrel bodies; each portion of the barrel body edge is serrated shaped, and the adjacent serrated-shaped portions of the barrel body form a blade slot for positioning the serrated-shaped blade; the blade edge is corresponding to the teeth on the serrated shaped edge; a driver unit is installed in the interior cavity to make the blade move along the barrel axially to cut the wrapped in the tooth groove. The blade edge is corresponding to the teeth, and the serrated blade is completely hidden in the accommodating space formed by the toothed edges when the roller is in still state to ensure the safety. When the blade is pushed by the drive unit to move along the barrel axially the wrapped in the tooth groove is cut.

Specifically, in order to push the blade move along the barrel axially, the drive unit may be driven by mechanical force. More specifically the driver unit comprises a centrifugal member and an elastic recovery part; the centrifugal member pushes the blade to move along the roller axially, and the elastic recovery part makes the blade return to the still state with elastic force.

When the roller brush is in still state, all the teeth of the blade edge is hidden in the accommodating space formed by the toothed edges, when the roller brush is accelerated to start, the blade is driven to move by the centrifugal force generated by the centrifugal member in the internal cavity and a certain elastic deformation of the elastic recovery part is caused to reveal the teeth of the blade edge to realize the cutting. When the roller brush rotates to work, the centrifugal member and the elastic recovery part co-act on the blade to keep the blade balanced, thus all the teeth of the blade edge is again hidden in the accommodating space formed by the toothed edges; when the roller brush decelerates to stop, the centrifugal force is gradually reduced to zero while the elastic force of the elastic recovery part pushes the blade to move back to the original place to reveal the teeth of the blade edge to realize the cutting. Accordingly, there are two lateral displacement of the blade for cutting the wrapped in the tooth groove during the starting and stopping process. And all the teeth of the blade edge is again hidden in the accommodating space formed by the toothed edges when the roller brush is in still state and rotating as no cutting is done.

Although the movement of the blade is limited by the centrifugal member and the elastic recovery part, the interior cavity is further provided with a limiting block to restrict the blade to move along the roller axially to guarantee the safety. The blade stops moving when it touches the limiting block.

In particular, the distance that the blade moves along the roller axially is positive integral multiple of the distance between the teeth on the serrated shaped edge to improve the cutting efficiency and ensure no damage caused to the user in the still state and to the cleaning surface in operation. In other words, when the roller brush is in still state and in operation, all the teeth of the blade edge is again hidden in the accommodating space formed by the toothed edges, and when the roller brush is turned on and off, the teeth of the blade are revealed for cutting twice and the distance that the blade moves along the roller axially is positive integral multiple of the distance between the teeth.

To further improve the cutting efficiency, the blade comprises a fixed blade and a movable blade; the fixed blade is fixed to the serrated-shaped edge of the barrel body, and the movable blade can move along the roller axially. During the movement of the movable blade, a sharper incision is formed with the fixed blade.

To urge the blade to move laterally by the centrifugal force and return to the original position by the elastic force, the inner cavity further comprises an ejector block shaft fixedly connected with the barrel body at the center; the blade comprises a pushing part and a supporting part the centrifugal member includes two symmetrical centrifugal ejector blocks; one end of the centrifugal ejector block is connected with the ejector block shaft, and the other end contacts the pushing part of the blade; the elastic recovery part comprises a spring seat fixed on the barrel body; the spring seat is provided with a first spring; one end of the first spring is connected with the spring seat and the other end is connected with the supporting part of the blade.

The other option to urge the blade to move laterally by the centrifugal force and return to the original position by the elastic force is that the blade comprises a pushing part and a supporting part; the inner cavity is provided with a sliding groove and a holder; the sliding grooves are symmetrically distributed on both sides of the center roller; the sliding groove comprises two movable metal balls; the elastic recovery part comprises a spring seat fixed to the barrel body; the spring seat is mounted with a first spring; one end of the first spring is connected with the spring seat, and the other end is connected with the supporting part of the blade.

Another option to urge the blade to move laterally by the centrifugal force and return to the original position by the elastic force is that the movable blade is consisted with 2 separate blades symmetrically mounted at the edge of the barrel body, each movable blade contains an opening and a lead column through the opening on the edge of the barrel body; the side close to the center roller of the movable blade comprises pushing teeth; the centrifugal member comprises a fluted disc fixed to the barrel body by a fluted disc shaft, and is perpendicular to the axial direction of the barrel body; the fluted disc is symmetrically arranged with the gears rotating with fluted disc and meshing with the pushing teeth, one side of the gear comprises a centrifugal pendulum; the other side of the centrifugal pendulum comprises a limiting rod for limiting the rotational track of the fluted disc; the elastic recovery part comprises a second spring, and the second spring is embedded on the movable blade along the roller axially.

To ensure the blade to move along the roller axially, the driver unit can be an electric drive unit and the electric drive unit uses electricity to drive the blade to move along the roller axially and/or to return to the still state after the movement.

And the barrel bodies can be connected by fasteners or adhesives to form the main shaft of the roller brush.

Some advantages of the present disclosure: 1. It's convenient and effective to cut the wrapped in the tooth groove by the lateral displacement of the blade. 2. Many implementations to realize the movement of the blade. The blade can be driven by a mechanical force or an electrical force and different settings are available according to the size of the internal cavity. 3. If the present disclose adopts the mechanical force to drive the roller brush, the driver unit comprises a centrifugal member and an elastic recovery part; the centrifugal member pushes the blade to move along the roller axially, and the elastic recovery part makes the blade return to the still state with elastic force. Thus two automatic cutting are done when the roller brush is turned on and off, which is more user-friendly. 4. The serrated blade is completely hidden in the accommodating space formed by the toothed edges when the roller is in still state to ensure no potential harm. 5. The serrated blade is completely hidden in the accommodating space formed by the toothed edges when the roller is in operation to cause no harm to the cleaning surface such as carpet or fabric. 6. The cut wrap will be drawn into the dust collector when the roller bush is in operation since the length of the cut wrap is less than the circumference length of the barrel. 7. The structure adopted in the present disclosure is simple and relatively difficult to be damaged, and no additional space of the cleaning appliance is required since the blade is set in the interior cavity of the roller brush.

BRIEF DESCRIPTION OF THE DRAWINGS

The present disclosure is illustrated by way of examples and is not limited by the accompanying drawings, in which similar reference numbers indicate similar elements, and in which.

REFERENCE NUMBERS

1. barrel body; 2. brush; 3. tooth; 4. tooth edge; 5. blade; 501. fixed blade; 502. movable blade; 503. pushing part; 504. supporting part; 6. ejector block shaft; 8. centrifugal ejector block; 9. first spring; 10. spring seat 11. limiting block; 12. holder; 13. sliding groove; 14. metal ball; 15. centrifugal pendulum; 16. fluted disc; 17. fluted disc shaft 18. pushing teeth; 19. limiting rod; 20. gear; 21. lead column; 22. second spring.

DETAILED DESCRIPTION

Various aspects of the illustrative embodiments of the present disclosure will be described herein using terms commonly employed by those skilled in the art. However, it will be apparent to those skilled in the art that alternate embodiments may be practiced with only some of the described aspects. For purposes of explanation, specific numbers, materials and configurations are set forth in order to provide a thorough understanding of the illustrative embodiments. It will be apparent that alternate embodiments may be practiced without the specific details. In other instances, well-known features are omitted or simplified in order not to obscure the illustrative embodiments.

It will be understood that, although the terms "first", "second", "third", etc. may be used herein to describe various elements, these elements should not be limited by these terms to indicate or imply any relative importance. These terms are only used to distinguish one element from another. For example, a first element could be termed a second element without departing from the scope of the present disclosure. The terms "center", "upper", "lower", "left", "right", "vertical", "lateral", "inner", "outer", etc. may indicate directions or positions as illustrated in some of the drawings. These terms are only used in order not to obscure the description, and should not be construed as an indication of a particular position relation or sequence. As used herein, the term "and/or" includes any and all combinations of one or more of the associated listed items.

Embodiment 1

Figure 1:
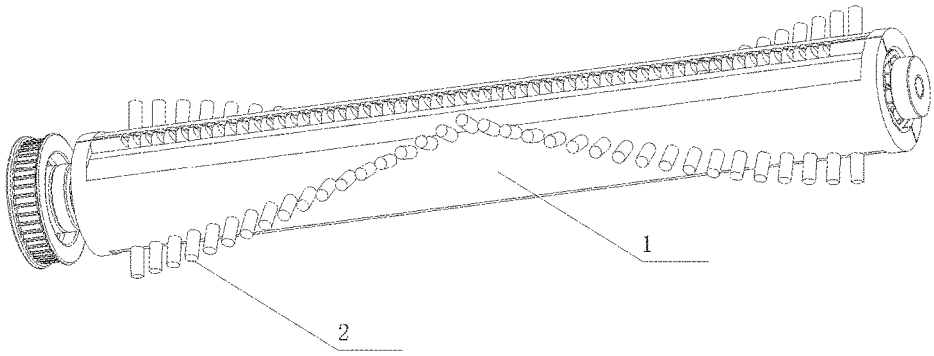
FIG. 1 illustrates a schematic perspective view according to embodiment 1.
Figure 2:
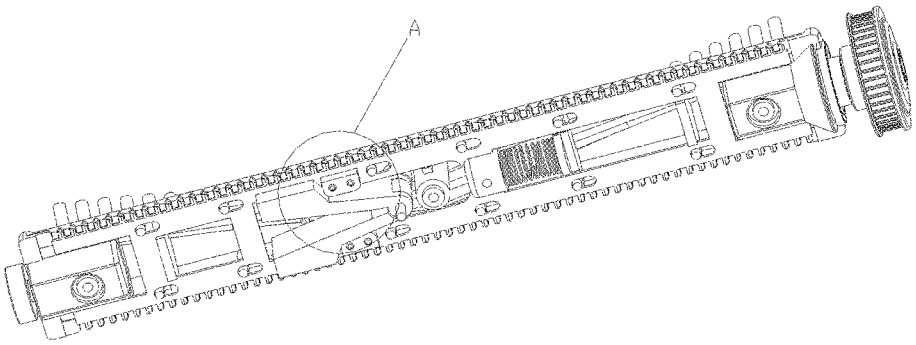
FIG. 2 illustrates an internal structural schematic diagram of the roller in the state of operation according to embodiment 1.
Figure 3:
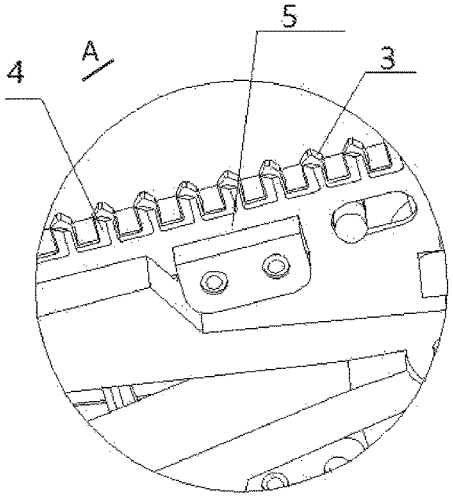
FIG. 3 illustrates a partial enlarged view of A according to embodiment 1.

A roller brush assembly including a roller and a brush 2 set on the roller, as demonstrated in FIG. 1, the roller is composed of two semi-cylindrical barrel bodies 1 which may be fastened together by screws or wedged with glue or by ultrasonic waves. Each of the semi-cylindrical body comprises a toothed edge including plurality of teeth 3 on both sides. As the two semi-cylindrical barrel bodies form into a roller, the adjacent serrated-shaped portions of the barrel body form a blade slot for positioning the serrated-shaped blade 5. With a bilaterally-symmetrical serrated tooth edge 4, the blade 5 is embedded in the two blade slots. The relative movements of tooth edge 4 and tooth 3 along the barrel axially form a shear space for cutting the wrapped (see FIGS. 2 and 3) The blade is driven to a lateral movement by the centrifugal force generated by the centrifugal member set in the interior cavity constituted by the two semi-cylindrical barrel bodies 1. The interior cavity is further provided with a limiting block 11 to restrict the distance of the lateral movement of the blade 5 and an elastic recovery part which makes the blade return to the still state with elastic force.

Figure 4:
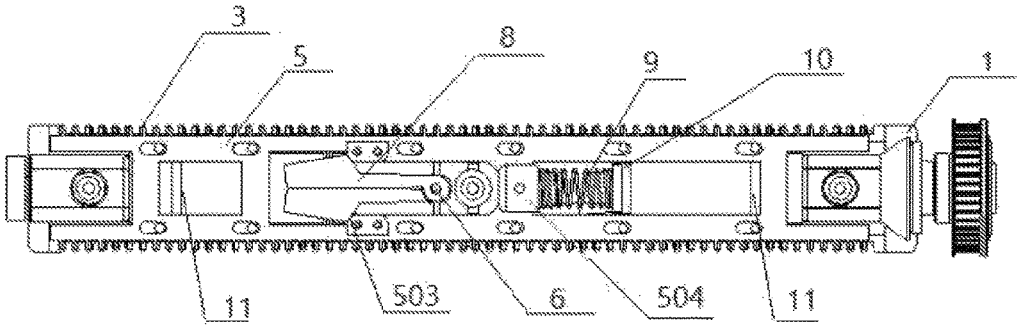
FIG. 4 illustrates a schematic diagram of the internal structure in a still state of the roller according to embodiment 1.
Figure 5:
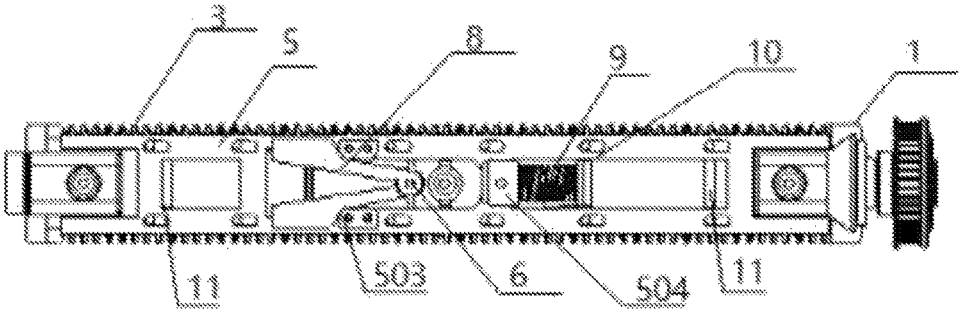
FIG. 5 illustrates an internal structural schematic diagram of the roller in the state of operation according to embodiment 1.

As indicated by FIGS. 4 and 5, the inner cavity further comprises an ejector block shaft 6 fixedly connected with the barrel body 1 at the center; blade 5 comprises pushing part 503 and supporting part 504; the centrifugal member includes two symmetrical centrifugal ejector blocks 8; one end of centrifugal ejector block 8 is connected with ejector block shaft 6, and the other end contacts the pushing part of blade 503; the elastic recovery part comprises spring seat 10 fixed on barrel body 1; spring seat 10 is provided with first spring 9; one end of first spring 9 is connected with spring seat 10 and the other end is connected with supporting part 504 of the blade.

In the structure mentioned above, the lateral movement of the blade is enabled by the centrifugal ejector block and the first spring.

FIG. 4 illustrates a schematic diagram of the internal structure in a still state of the roller. When the vacuum cleaner stops operating and stays in the still state, the pendulums of two centrifugal ejector blocks 8 are kept together by first spring 9 via pushing portion 503 of the blade. Meanwhile all teeth edges 4 of blade 5 are completely hidden in adjacent teeth 3. When the cleaner operates and the roller rotates, the pendulums of two centrifugal ejector blocks 8 separates towards the toothed edge by the centrifugal force generated by the rotation, and the backside of the pendulums touches pushing portion 503 of the blade to push blade 5 to do the lateral movement and the first spring is also compressed by the centrifugal force to push the blade to one side of the spring seat. During this process, tooth edge 4 of blade 5 will cut the wrapped wound between teeth 3, and the cut wrap will be drawn into the dust collector when the roller brush is in operation since the length of the cut wrap is less than the circumference length of the barrel.

When the two pendulums of centrifugal ejector blocks 8 are fully separated or blade 5 reaches limiting block 11 after moving the distance that is positive integral multiple of the distance between the teeth on the serrated shaped edge, blade 5 stops moving, and all teeth edges 4 of blade 5 are again completely hidden in adjacent teeth 3 as shown in FIG. 5. Due to the limitation of the internal cavity space and/or limiting block 11, the blade will not continue to move despite of the high-speed rotation. Accordingly, when the roller is held in rotary working state as shown in FIG. 5, the blade will cause no harm to the cleaning surface such as carpet or fabric while hair and the like wound in the slot between teeth 3.

The centrifugal force on the pendulums of centrifugal ejector block disappears when the vacuum cleaner is turned off and the roller stops rotating, and blade 5 is reset by the spring force to return to the still state as shown in FIG. 4. During this process, the wrapped wound between teeth 3 are cut by tooth edge 4 of blade 5. Subjected to the limitation of the pendulum of the centrifugal ejector block and/or limiting block 11, blade 5 stops moving and all teeth edges 4 of blade 5 are again completely hidden in adjacent teeth 3 to be in the safe still state.

The present disclosure has realized two efficient and automatic cutting of the wrapped in the tooth groove when the user turns on and off the vacuum cleaner.

Embodiment 2

A roller brush assembly including a roller and brush 2 set on the roller, as demonstrated in FIG. 1, the roller is composed of two semi-cylindrical barrel bodies 1 which may be fastened together by screws or wedged with glue or by ultrasonic waves.

Each of the semi-cylindrical body comprises a toothed edge including plurality of teeth 3 on both sides. As the two semi-cylindrical barrel bodies form into a roller, the adjacent serrated-shaped portions of the barrel body form a blade slot for positioning serrated-shaped blade 5. With a bilaterally-symmetrical serrated tooth edge 4, blade 5 is embedded in the two blade slots. The relative movements of tooth edge 4 and tooth 3 along the cylinder axially form a shear space for cutting the wrapped (see FIGS. 2 and 3) The blade is driven to a lateral movement by the centrifugal force generated by the centrifugal member set in the interior cavity constituted by two semi-cylindrical barrel bodies 1. The said interior cavity is further provided with limiting block 11 to restrict the distance of the lateral movement of blade 5 and an elastic recovery part which makes the blade return to the still state with elastic force.

Figure 6:
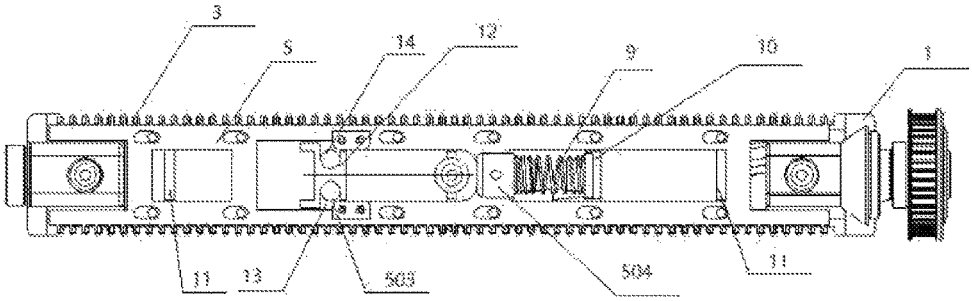
FIG. 6 illustrates a schematic diagram of the internal structure in a still state of the roller according to embodiment 2.
Figure 7:
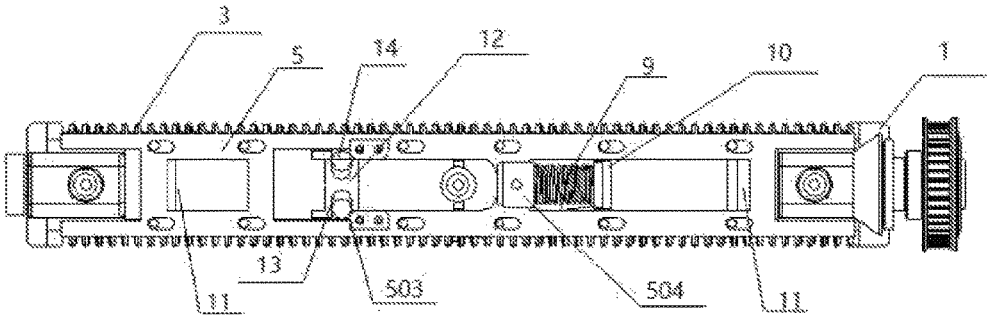
FIG. 7 illustrates an internal structural schematic diagram of the roller in the state of operation according to embodiment 2.

As indicated in FIGS. 6 and 7, blade 5 comprises a pushing part 503 and supporting part 504; the inner cavity is provided with sliding groove 13 and holder 12; sliding grooves 13 are symmetrically distributed on both sides of the center roller; sliding groove 13 comprises two movable metal balls 14; the elastic recovery part comprises spring seat 10 fixed to barrel body 1; spring seat 10 is mounted with first spring 9; one end of first spring 9 is connected with spring seat 10, and the other end is connected with supporting part 504 of the blade.

In the structure mentioned above, the lateral movement of the blade is enabled by the metal ball and the spring.

FIG. 6 illustrates a schematic diagram of the internal structure in a still state of the roller. When the vacuum cleaner stops operating and stays in the still state, two metal balls 14 fall in the bottom of sliding groove 13 of holder 12 by spring 9 via pushing portion 503 of the blade. Meanwhile all teeth edges 4 of blade 5 are completely hidden in adjacent teeth 3. When the cleaner operates and the roller rotates, two metal balls 14 separately slide to the top of the sliding groove towards the toothed edge by the centrifugal force generated by the rotation. The surface of metal ball 14 touches pushing portion 503 of the blade to push blade 5 to do the lateral movement and the first spring is also compressed by the centrifugal force to push the blade to one side of the spring seat. During this process, tooth edge 4 of blade 5 will cut the wrapped wound between teeth 3, and the cut wrap will be drawn into the dust collector when the roller brush is in operation since the length of the cut wrap is less than the circumference length of the barrel.

After moving the distance that is positive integral multiple of the distance between the teeth on the serrated shaped edge, blade 5 is limited by the internal cavity space and/or limiting block 11 and stops moving, and all teeth edges 4 of blade 5 are again completely hidden in adjacent teeth 3 as shown in FIG. 7. Due to the limitation of the internal cavity space and/or limiting block 11, the blade will not continue to move despite of the high-speed rotation. Accordingly, when the roller is held in rotary working state as shown in FIG. 7, the blade will cause no harm to the cleaning surface such as carpet or fabric while hair and the like wound in the slot between teeth 3.

The centrifugal force on metal ball 14 disappears when the vacuum cleaner is turned off and the roller stops rotating, and blade 5 is reset by the spring force to return to the still state as shown in FIG. 6. During this process, the wrapped wound between teeth 3 are cut by tooth edge 4 of blade 5. Subjected to the limitation of holder 12 and/or limiting block 11, blade 5 stops moving and all teeth edges 4 of blade 5 are again completely hidden in adjacent teeth 3 to be in the safe still state.

The present disclosure has realized two efficient and automatic cutting of the wrapped in the tooth groove when the user turns on and off the vacuum cleaner.

Embodiment 3

Figure 8:
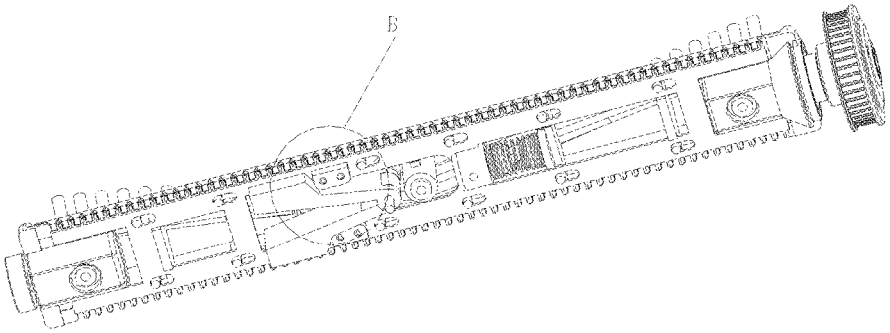
FIG. 8 illustrates an internal structural schematic diagram of the roller in the state of operation according to embodiment 3.
Figure 9:
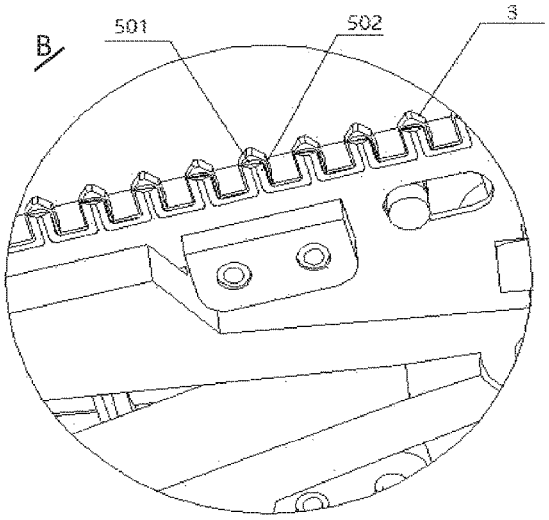
FIG. 9 illustrates a partial enlarged view of B according to embodiment 3.

To further improve the cutting efficiency, the blade can comprise a fixed blade and a movable blade as shown in FIG. 8; fixed blade 501 is fixed to the serrated-shaped edge of barrel body 1, and movable blade 502 can move along the roller axially. The rest of the structure is similar to embodiment 1. During the movement of the movable blade, a sharper incision is formed with the fixed blade.

Embodiment 4

A roller brush assembly including a roller and brush 2 set on the roller, as demonstrated in FIG. 1, the roller is composed of two semi-cylindrical barrel bodies 1 which may be fastened together by screws or wedged with glue or by ultrasonic waves.

Each of the semi-cylindrical body comprises a toothed edge including plurality of teeth 3 on both sides. As the two semi-cylindrical barrel bodies form into a roller, the adjacent serrated-shaped portions of the barrel body form a blade slot for positioning serrated-shaped blade 5. With bilaterally-symmetrical serrated tooth edge 4, blade 5 is embedded in the two blade slots. The relative movements of tooth edge 4 and tooth 3 along the cylinder axially form a shear space for cutting the wrapped.

Figure 10:
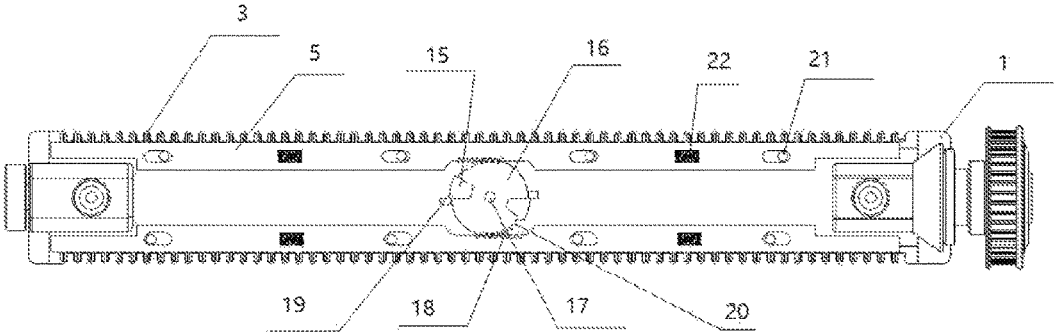
FIG. 10 illustrates an internal structural schematic diagram of the roller in the state of operation according to embodiment 4.

To further improve the cutting efficiency, the blade can comprise a fixed blade and a movable blade as shown in FIG. 8; fixed blade 501 is fixed to the serrated-shaped edge of barrel body 1, and movable blade 502 can move along the roller axially. During the movement of the movable blade, a sharper incision is formed with the fixed blade. Movable blade 502 is further consisted with 2 separate blades symmetrically mounted at the edge of barrel body 1 as shown in FIG. 10, each movable blade 502 contains an opening and lead column 21 through the opening on the edge of barrel body 1; the side close to the center roller of movable blade 502 comprises pushing teeth 18; the centrifugal member comprises fluted disc 16 fixed to barrel body 1 by a fluted disc shaft 17, and is perpendicular to the axial direction of the barrel body 1; fluted disc 16 is symmetrically arranged with gears 20 rotating with fluted disc 16 and meshing with pushing teeth 18, one side of gear 20 comprises centrifugal pendulum 15; the other side of centrifugal pendulum 15 comprises limiting rod 19 for limiting the rotational track of fluted disc 16 and the location of the blade in the still state. Movable blade 502 is respectively embedded with two springs in the reserved spring slot on the edge of the barrel. Two centrifugal pendulums 15 swung to the edge of barrel 1 under the influence of the centrifugal force generated by the rotation, gear 20 rotates with fluted disc 16 and pushes the blade to move along lead column 21 on edge of barrel 1 laterally. Second spring 22 is also compressed by the centrifugal force, and the fixed blade and the movable blade move relatively to realize a complete cutting. Lead column 21 also plays a limiting role in the process. When the vacuum cleaner is turned off and the roller stops rotating, the centrifugal force disappears and second spring 22 rebound while the blade moves laterally in the opposite direction to lead column 21 on the edge of barrel 1 to realize another cutting. Fluted disc 16 also returns to the original position.

The present disclosure has realized two efficient and automatic cutting of the wrapped in the tooth groove when the user turns on and off the vacuum cleaner.

Embodiment 5

A roller brush assembly including a roller and brush 2 set on the roller, as demonstrated in FIG. 1, the roller is composed of two semi-cylindrical barrel bodies 1 which may be fastened together by screws or wedged with glue or by ultrasonic waves.

Each of the semi-cylindrical body comprises a toothed edge including plurality of teeth 3 on both sides. As the two semi-cylindrical barrel bodies form into a roller, the adjacent serrated-shaped portions of the barrel body form a blade slot for positioning serrated-shaped blade 5. With bilaterally-symmetrical serrated tooth edge 4, blade 5 is embedded in the two blade slots. The relative movements of tooth edge 4 and tooth 3 along the cylinder axially form a shear space for cutting the wrapped.

To ensure the axial movement along the roller of the blade, the driver unit can be electric drive unit and the electric drive unit uses electricity to drive blade 5 to move along the roller axially and/or to return to the still state after the movement. As the relatively high cost of the electric drive unit, this part is therefore not described in details herein again. The present disclosure has realized two efficient and automatic cutting of the wrapped in the tooth groove when the user turns on and off the vacuum cleaner.

Although certain embodiments have been illustrated and described herein for purposes of description, a wide variety of alternate and/or equivalent embodiments or implementations calculated to achieve the same purposes may be substituted for the embodiments shown and described without departing from the scope of present disclosure. This application is intended to cover any adaptations or variations of the embodiments discussed herein. Therefore, it is manifestly intended that embodiments described herein be limited only by the claims and the equivalents thereof.

The invention claimed is:

1. A roller brush assembly comprising a roller and a brush set disposed on the roller:

wherein the roller contains an interior cavity constituted by at least two barrel bodies;

wherein each barrel body has a barrel body edge;

each portion of the barrel body edge is serrated shaped, and adjacent serrated-shaped portions of the barrel body form a blade slot for positioning a blade, wherein the blade is a serrated-shaped blade;

wherein, a blade edge corresponds to a plurality of teeth on the adjacent serrated-shaped portions of the barrel body forming the blade;

wherein, a driver unit is installed in the interior cavity to make the blade move along the barrel bodies axially to cut a filament wrapped in a tooth groove.

2. The roller brush assembly of claim 1, wherein the driver unit comprises a centrifugal member and an elastic recovery part; the centrifugal member pushes the blade to move along the roller axially, and the elastic recovery part makes the blade return to a still state with elastic force.

3. The roller brush assembly of claim 2, wherein the interior cavity is further provided with a limiting block to restrict the blade to move along the roller axially.

4. The roller brush assembly of claim 3, wherein the interior cavity further comprises an ejector block shaft fixedly connected with the barrel body at the center; the blade comprises a pushing part and a supporting part; the centrifugal member includes two symmetrical centrifugal ejector blocks; one end of the centrifugal ejector block is connected with the ejector block shaft, and the other end contacts the pushing part of the blade; the elastic recovery part comprises a spring seat fixed on the barrel body; the spring seat is provided with a first spring; one end of the first spring is connected with the spring seat and the other end is connected with the supporting part of the blade.

5. The roller brush assembly of claim 2, wherein a distance that the blade moves along the roller axially is positive integral multiple of a distance between the teeth on the serrated shaped edge.

6. The roller brush assembly of claim 5, wherein the interior cavity further comprises an ejector block shaft fixedly connected with the barrel body at the center; the blade comprises a pushing part and a supporting part; the centrifugal member includes two symmetrical centrifugal ejector blocks; one end of the centrifugal ejector block is connected with the ejector block shaft, and the other end contacts the pushing part of the blade; the elastic recovery part comprises a spring seat fixed on the barrel body; the spring seat is provided with a first spring; one end of the first spring is connected with the spring seat and the other end is connected with the supporting part of the blade.

7. The roller brush assembly of claim 5, wherein the blade comprises a pushing part and a supporting part; the interior cavity is provided with a sliding groove and a holder; the sliding grooves are symmetrically distributed on both sides of the center roller and comprise two movable metal balls; the elastic recovery part comprises a spring seat fixed to the barrel body; the spring seat is mounted with a first spring; one end of the first spring is connected with the spring seat, and the other end is connected with the supporting part of the blade.

8. The roller brush assembly of claim 2, wherein the blade comprises a fixed blade and a movable blade; the fixed blade is fixed to the serrated-shaped edge of the barrel body, and the movable blade can move along the roller axially.

9. The roller brush assembly of claim 8, wherein the interior cavity further comprises an ejector block shaft fixedly connected with the barrel body at the center; the blade comprises a pushing part and a supporting part; the centrifugal member includes two symmetrical centrifugal ejector blocks; one end of the centrifugal ejector block is connected with the ejector block shaft, and the other end contacts the pushing part of the blade; the elastic recovery part comprises a spring seat fixed on the barrel body; the spring seat is provided with a first spring; one end of the first spring is connected with the spring seat and the other end is connected with the supporting part of the blade.

10. The roller brush assembly of claim 8, wherein the blade comprises a pushing part and a supporting part; the interior cavity is provided with a sliding groove and a holder; the sliding grooves are symmetrically distributed on both sides of the center roller and comprise two movable metal balls; the elastic recovery part comprises a spring seat fixed to the barrel body; the spring seat is mounted with a first spring; one end of the first spring is connected with the spring seat, and the other end is connected with the supporting part of the blade.

11. The roller brush assembly of claim 8, wherein the movable blade is consisted with 2 separate blades symmetrically mounted at the edge of the barrel body, each movable blade contains an opening and a lead column through the opening on the edge of the barrel body; the side close to the center roller of the movable blade comprises pushing teeth; the centrifugal member comprises a fluted disc fixed to the barrel body by a fluted disc shaft, and is perpendicular to the axial direction of the barrel body; the fluted disc is symmetrically arranged with the gears rotating with fluted disc and meshing with the pushing teeth, one side of the gear comprises a centrifugal pendulum; the other side of the centrifugal pendulum comprises a limiting rod for limiting the rotational track of the fluted disc; the elastic recovery part comprises a second spring, and the second spring is embedded on the movable blade along the roller axially.

12. The roller brush assembly of claim 11, wherein the interior cavity is further provided with a limiting block to restrict the blade to move along the roller axially.

13. The roller brush assembly of claim 11, wherein a distance that the blade moves along the roller axially is positive integral multiple of a distance between the teeth on the serrated shaped edge.

14. The roller brush assembly of claim 2, wherein the interior cavity further comprises an ejector block shaft fixedly connected with the barrel body at the center; the blade comprises a pushing part and a supporting part; the centrifugal member includes two symmetrical centrifugal ejector blocks; one end of the centrifugal ejector block is connected with the ejector block shaft, and the other end contacts the pushing part of the blade; the elastic recovery part comprises a spring seat fixed on the barrel body; the spring seat is provided with a first spring; one end of the first spring is connected with the spring seat and the other end is connected with the supporting part of the blade.

15. The roller brush assembly of claim 2, wherein the blade comprises a pushing part and a supporting part; the interior cavity is provided with a sliding groove and a holder; the sliding grooves are symmetrically distributed on both sides of a center roller and comprise two movable metal balls; the elastic recovery part comprises a spring seat fixed to the barrel body; the spring seat is mounted with a first spring; one end of the first spring is connected with the spring seat, and the other end is connected with the supporting part of the blade.

16. The roller brush assembly of claim 3, wherein the blade comprises a pushing part and a supporting part; the interior cavity is provided with a sliding groove and a holder; the sliding grooves are symmetrically distributed on both sides of the center roller and comprise two movable metal balls; the elastic recovery part comprises a spring seat fixed to the barrel body; the spring seat is mounted with a first spring; one end of the first spring is connected with the spring seat, and the other end is connected with the supporting part of the blade.

17. The roller brush assembly of claim 1, wherein the driver unit is an electric drive unit and the electric drive unit uses electricity to drive the blade to move along the roller axially and/or to return to a still state after the movement.

18. The roller brush assembly of claim 1, wherein the barrel bodies are connected by fasteners or adhesives to form a main shaft of the roller brush.

* * * * *